US008234735B2

(12) United States Patent
Schultz

(10) Patent No.: US 8,234,735 B2
(45) **Date of Patent: *Aug. 7, 2012**

(54) METHOD AND SYSTEM FOR SPINAL ALIGNMENT

(75) Inventor: John Schultz, Seattle, WA (US)

(73) Assignee: Squire Sleep Systems LLC, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/755,172

(22) Filed: Apr. 6, 2010

(65) Prior Publication Data

US 2010/0186171 A1 Jul. 29, 2010

Related U.S. Application Data

(63) Continuation of application No. 12/470,741, filed on May 22, 2009, now Pat. No. 7,698,766, which is a continuation of application No. 12/020,363, filed on Jan. 25, 2008, now Pat. No. 7,536,741.

(51) Int. Cl.
*A47C 27/14* (2006.01)
*A47C 20/02* (2006.01)

(52) U.S. Cl. ..... 5/733; 5/734; 5/632

(58) Field of Classification Search ..... 5/731–735, 5/694, 724, 646, 631, 632
See application file for complete search history.

(56) References Cited

U.S. PATENT DOCUMENTS

| | | | |
|---|---|---|---|
| 254,759 | A | 3/1882 | Young |
| 433,905 | A | 8/1890 | Muller |
| 929,449 | A | 7/1909 | Klimowicz et al. |
| 1,548,728 | A | 8/1925 | Milam |
| 2,182,861 | A | 12/1939 | Albert |
| 2,550,293 | A | 4/1951 | Platis |
| 3,608,103 | A | 9/1971 | Seid |
| 4,028,754 | A | 6/1977 | Eary, Sr. |
| 5,054,142 | A | 10/1991 | Owens |
| 5,214,814 | A | 6/1993 | Eremita et al. |
| 5,720,061 | A | 2/1998 | Giori et al. |
| 5,893,183 | A | 4/1999 | Bechtold, Jr. |
| 6,038,722 | A | 3/2000 | Giori et al. |
| 6,154,903 | A | 12/2000 | Wai-Chung |
| 6,185,768 | B1 | 2/2001 | Schlechter |
| 7,020,918 | B1 | 4/2006 | Tinsley |
| 7,536,741 | B1 | 5/2009 | Schultz |
| 7,698,766 | B2 | 4/2010 | Schultz |
| 2006/0096034 | A1 | 5/2006 | Tucci |

OTHER PUBLICATIONS

Stephanie Zinser, "Can this 'superbed' give you the perfect sleep?", Daily Mail, Good Health / Innovations, Aug. 17, 1999, p. 35.
Dale T. Read, A New Paradigm in Mattresses and Beds?, Specialty Sleep Association News, Sep. 18, 2007, http//www.sleepinformation.org/news.htm.

*Primary Examiner* — Michael Trettel
(74) *Attorney, Agent, or Firm* — Lowe Graham Jones PLLC

(57) ABSTRACT

A method and apparatus for facilitating spinal alignment is disclosed. The contoured sleep system facilitates alignment of a person's spine along the Sagittal plane when laying in a sleep-on-side position. An exemplary contoured sleep system has a unibody trunk rest, head rest and spacing member.

13 Claims, 12 Drawing Sheets

METHOD AND SYSTEM FOR SPINAL ALIGNMENT

PRIORITY CLAIM

This application is a Continuation of U.S. patent application Ser. No. 12/470,741 filed May 22, 2009, and now U.S. Pat. No. 7,698,766, which is a Continuation of Ser. No. 12/020,363, now U.S. Pat. No. 7,536,741, filed Jan. 25, 2008, both of which are incorporated by reference in their entirety.

BACKGROUND OF THE INVENTION

Various sleeping problems are commonly experienced by many people. For example, a person sleeping on a flat mattress may experience back aches and pains due to the non-alignment of their spine while sleeping. Furthermore, if the person's spine is not in alignment during sleep, discomfort, or injury may occur to the vertebrae disks, back muscles, and/or connecting ligaments.

As another example of a sleeping problem, if a person is sleeping on top of their arm, circulation to portions of the arm may be hindered. Such reduced circulation may result in a tingling, numbness, or even pain in the blood-deprived regions of the arm.

Nasal and sinus congestion may be exacerbated by sleeping on a flat mattress when the person is suffering from a cold or the flu. Further, acid reflux or the like are known to be more damaging at night when the afflicted person is sleeping.

FIG. 1 shows a lateral view 102 and a posterior view 104 of a spine 106. The names of the various portions of the spine 106 are illustrated. FIG. 2 shows anatomical reference planes of a person 202, namely the Sagittal plane 204, the coronal plane 206, and the axial plane 208.

The lateral view 102 of person 202 illustrates a natural, healthy curvature of the spine 106 with respect to the coronal plane 206. The posterior view 104 of person 202 illustrates a natural, healthy alignment of the spine 106 with respect to the Sagittal plane 204. When spine 106 is aligned along the Sagittal plane 204 in the illustrated straight-line orientation, the person 202 will be in a relatively comfortable position (absent other spinal injury, such as herniated vertebrae disks, arthritis, or the like). When the spine 106 is not in the straight-line alignment along the Sagittal plane 204, the person 202 may experience some level of discomfort. If the nonalignment of the spine 106 along the Sagittal plane 204 is maintained for a relatively long period of time, such as when the person 202 is sleeping at night or resting in bed during recovery from an illness or the like, the level of discomfort may increase to a very undesirable level. As noted above, injury to the vertebrae disks, back muscles, and/or connecting ligaments may result.

FIG. 3 shows a front view of a person 202 laying in a sleep-on-side position 302 on a prior art mattress 303. The person's head 304 is laying on the person's lower arm 306. Pillow 308 is supporting the person's lower arm 306 and head 304. The person's upper shoulder 310, upper arm 312, upper hip 314, lower hip 316, upper leg 318, lower leg 320, upper foot 322, and lower foot 324 are illustrated for the person 204 laying in the sleep-on-side position 302. The trunk 326 is that portion of the person 202 from the shoulder blades 406, 408 to the hips 314, 316.

FIG. 4 shows a rear view of the person 202 laying in the sleep-on-side position 302 on the prior art mattress 303. The person's spine 106 (illustrated conceptually as a series of line-connected squares) is not in alignment along the Sagittal plane 204 while laying in the sleep-on-side position 302. The spine 106 is oriented in a curve about an upper region 402 near the shoulders (cervical and thoracic portions of spine 106) and in a curve about the lower region 404 near the hips (lumbar and sacrum portions of spine 106). The person's upper shoulder blade 406 and lower shoulder blade 408 are also conceptually illustrated, and are aligned along the illustrated plane 410.

While laying in the sleep-on-side position 302, the spinal curvatures 402 and 404 may result in compression of the vertebrae disks (not illustrated, but well known as the soft tissue separating individual vertebrae of the spine 106). Such compression of the vertebrae disks is undesirable, and may even result to injury of the vertebrae disks. Further, if the vertebrae disks are already injured, the compression of the vertebrae disks caused by the spinal curvatures 402 and 404 may exacerbate the pain and further injure the vertebrae disks.

As is apparent from FIG. 4, the plane 410 of the shoulder blades 406, 408 is oriented at a non-perpendicular angle with respect to the spine 106. This orientation of the shoulder blades 406, 408, alone or in combination with the spinal curvatures at regions 402 and/or 404, may result in discomfort and/or injury to the person's muscles and/or ligaments (not illustrated). For example, the person 202 may experience muscle spasms, cramping, and/or other types of back pain.

Accordingly, it is desirable to facilitate alignment of the spine 106 along the Sagittal plane 204 when the person 202 is laying in a sleep-on-side position 302. Further, it is desirable to facilitate alignment of the spine 106 along the Sagittal plane 204 when the person 202 is confined to bed rest during recovery from an illness or injury.

SUMMARY OF THE INVENTION

An apparatus for spinal alignment is used by a person laying in a sleep-on-side position. An exemplary contoured sleep system comprises a unibody trunk rest, head rest and spacing member.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Embodiments of the contoured sleep system facilitate alignment of a person's spine 106 at least along the Sagittal plane 204 when sleeping in the sleep-on-side position 302

Figure 3:
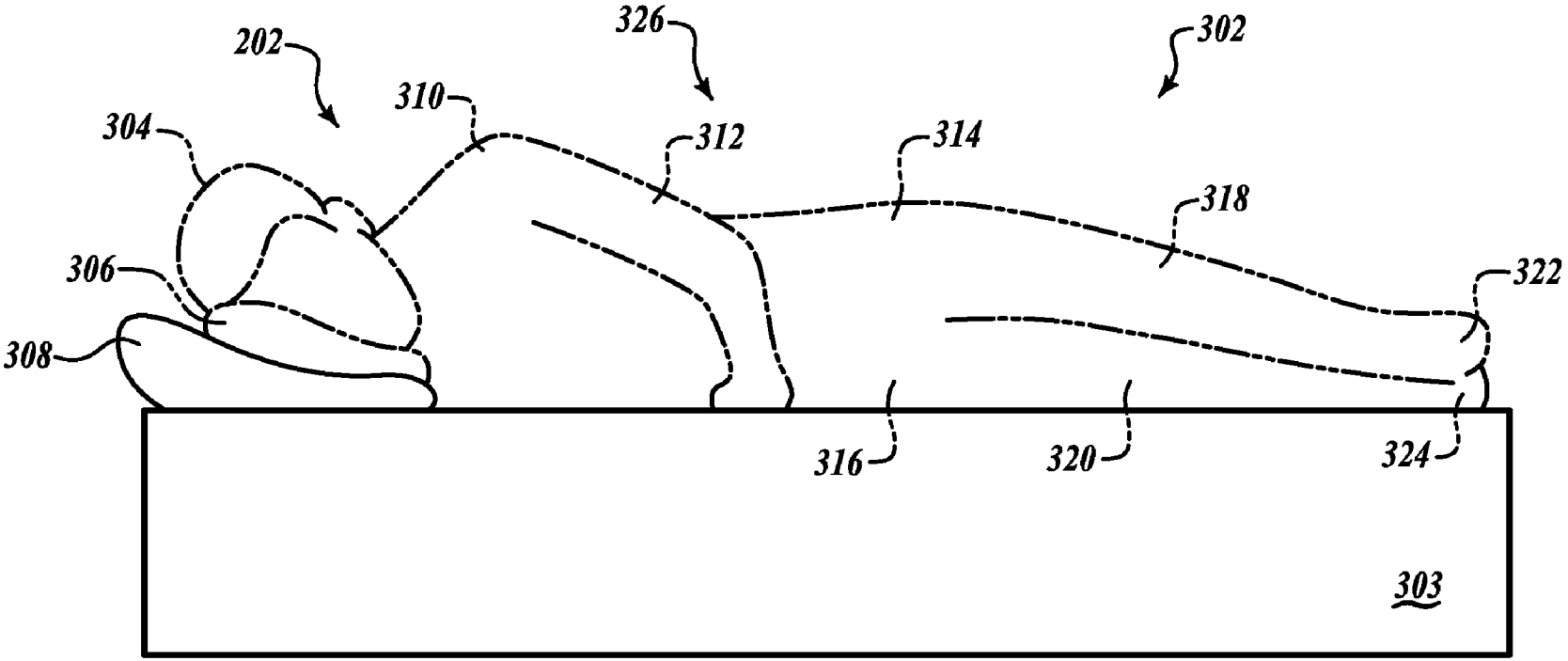
FIG.3 (PRIOR ART)
FIG. 3 shows a front view of a person laying in a sleep-on-side position on a prior art mattress.
Figure 4:
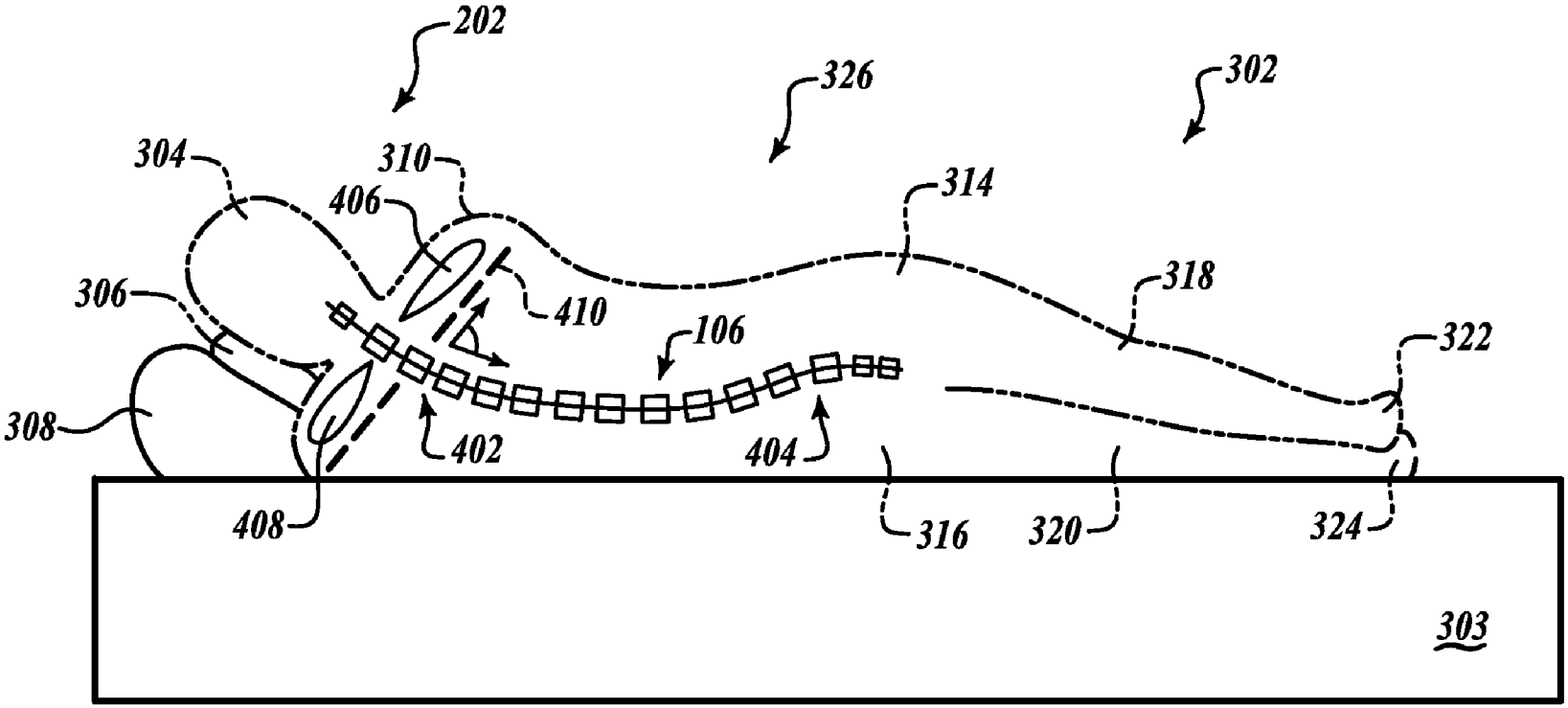
FIG. 4 (PRIOR ART)
FIG. 4 shows a rear view of the person laying in the sleep-on-side position on a prior art mattress.

(FIGS. 3 and 4, for example). Spinal alignment along the Sagittal plane 204 is facilitated by a cavity that receives the lower arm of a person laying in the sleep-on-side position 302. That is, portions of the spine 106 are positioned within the Sagittal plane 204. Other embodiments may include a hip concavity to receive a hip and/or leg concavity to receive a leg of the person laying in the sleep-on-side position. Non-limiting examples of various embodiments are described in greater detail hereinbelow.

Figure 5:
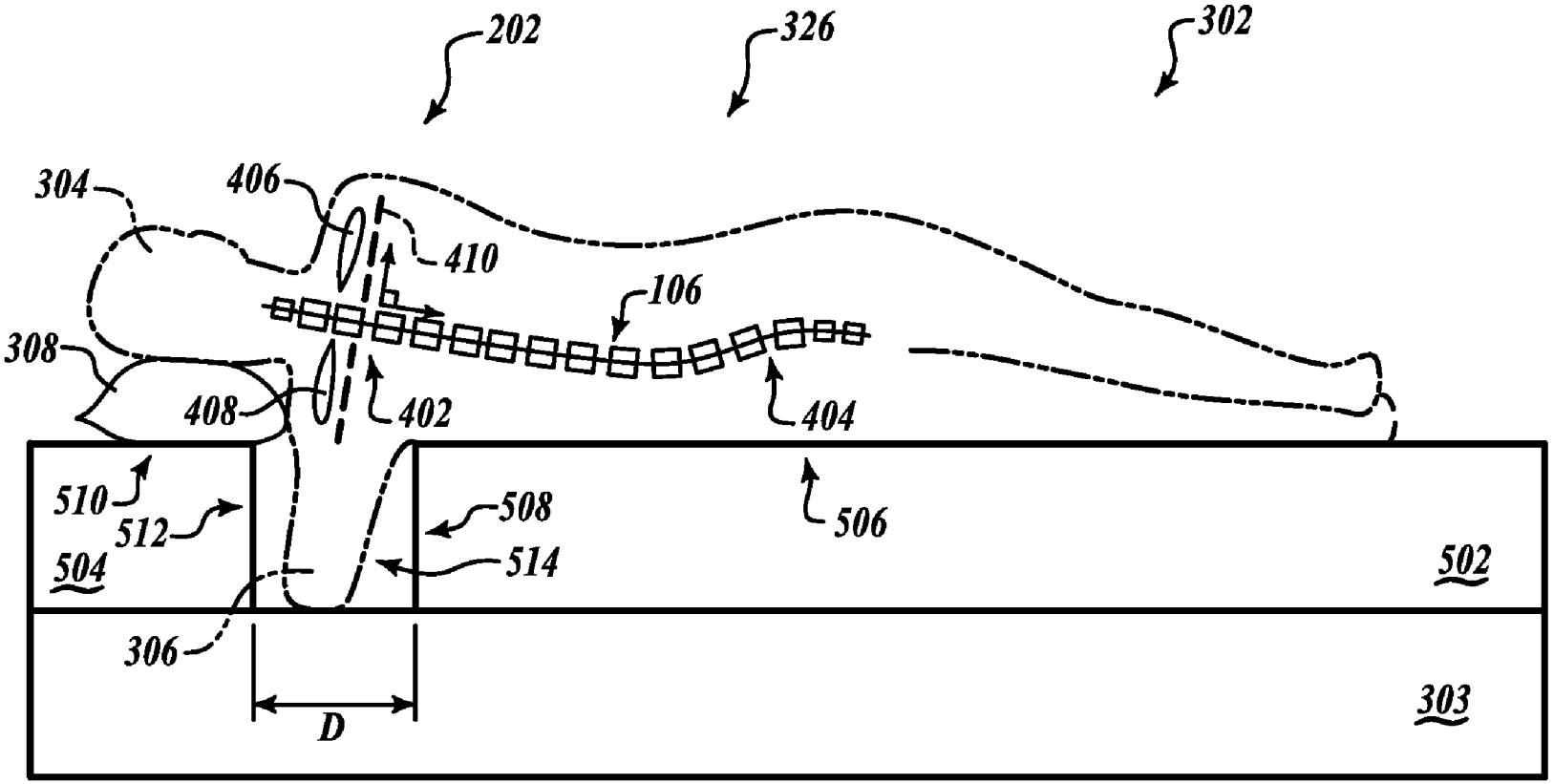
FIG. 5 shows an embodiment of the contoured sleep system with a person laying in a sleep-on-side position thereon.

FIG. 5 shows an embodiment of the contoured sleep system with a person 202 laying in a sleep-on-side position 302 thereon. This exemplary embodiment of a contoured sleep system includes a trunk rest 502 and a head rest 504. The trunk rest 502 and head rest 504 are on top of a conventional mattress 303 or on top of another suitable surface, such as a floor, base, or the like.

The trunk rest 502 is defined, in part, by a trunk rest surface 506 and a trunk rest face 508. The trunk rest surface 506 supports the trunk 326 of a person 202 laying in a sleep-on-side position 302.

The head rest 504 is defined, in part, by a head rest surface 510 and a head rest face 512. The head rest surface 510 supports the person's head 304 directly or indirectly via pillow 308.

A cavity 514 is defined in a space between the trunk rest 502 and the head rest 504. Accordingly, the head rest face 512 opposes the trunk rest face 508 and is separated from the trunk rest face 508 by a separation distance D such that the trunk rest 502 and the head rest 504 cooperate to define the cavity 514. Cavity 514 receives the lower arm 306 of the person 202 laying in the sleep-on-side position 302. The separation distance D may be fixed or may be adjustable.

Figure 2:
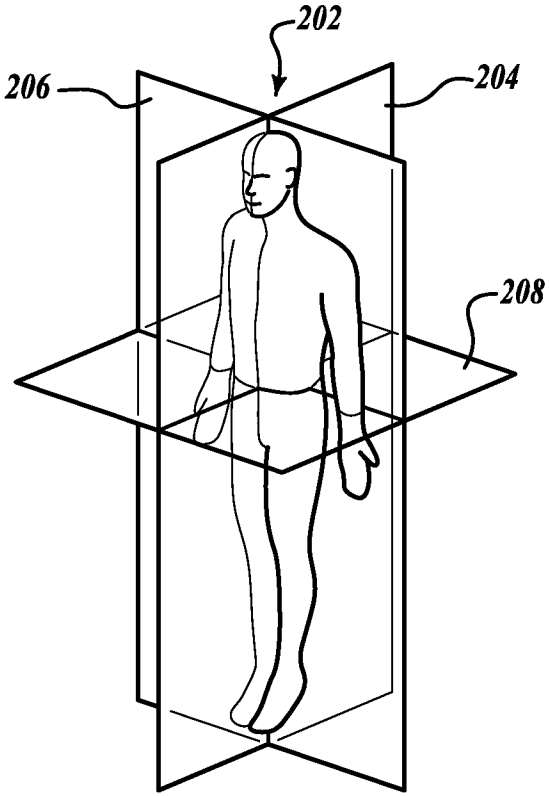
FIG. 2 (PRIOR ART)
FIG. 2 shows anatomical reference planes of a person.
Figure 1:
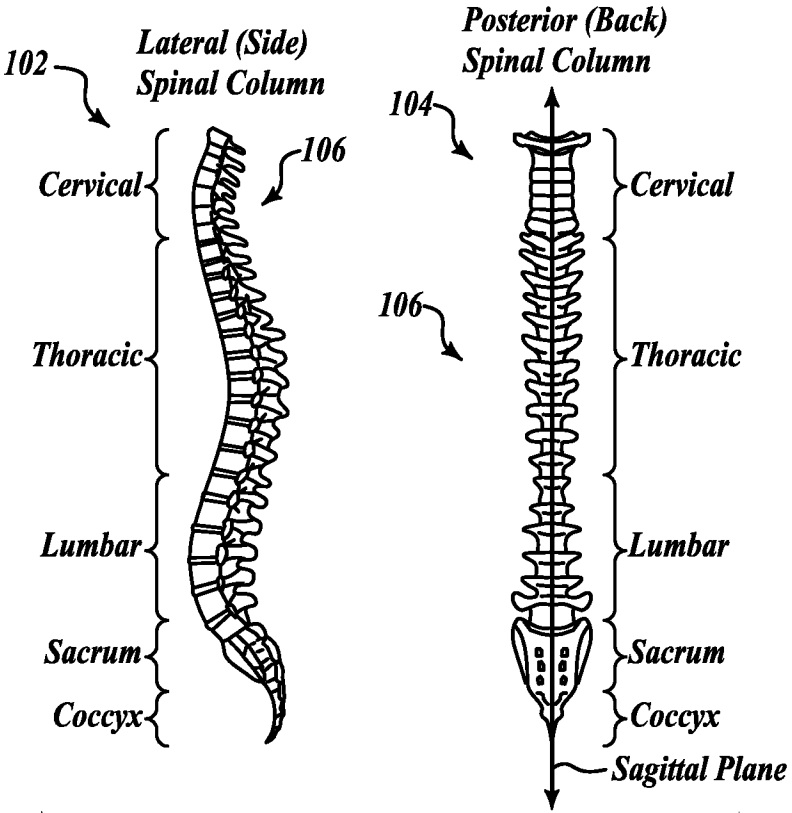
FIG. 1 (PRIOR ART)
FIG. 1 shows front and lateral views of a spine.

When the person's lower arm 306 is in the cavity 514, the spine region 402 is substantially aligned along the Sagittal plane 204 (FIG. 2). As illustrated in FIG. 5, the vertebrae of the spine 106 (conceptually corresponding to the illustrated line-connected boxes) about region 402 are substantially aligned. Since the vertebrae in the region 402 are aligned, compression of the vertebrae disks (not illustrated) between each vertebrae may be substantially reduced, or even eliminated, thereby resulting in less discomfort to the person 202 and/or may result in less injury to the vertebrae disks.

Further, the plane 410 of the shoulder blades 406, 408 is oriented at substantially a perpendicular angle with respect to the spine 106 about region 402. Accordingly, one skilled in the art appreciates that the illustrated orientation of the shoulder blades 406, 408 results in less discomfort and/or injury to the person's muscles and/or connecting ligaments (not illustrated). Also, the shoulder of the person laying in the sleep-on-side position is supported with the upper corner of the trunk rest 502.

Embodiments of the contoured sleep system employ comfortable, flexible materials in the construction of the trunk rest 502 and/or the head rest 504. Either may be constructed similar to a conventional mattress, adjustable position mattress, air bed, water bed, or poly material. The trunk rest 502 and the head rest 504 may be similarly constructed, or may be constructed of different materials.

Embodiments of the contoured sleep system that are configured to lay on top of a conventional mattress, the length and/or width of the trunk rest 502 and/or the head rest 504 may correspond to the underlying mattress. For example, the length and/or width of the trunk rest 502 and/or the head rest 504 may correspond to twin, double, single, Queen, King, or other mattress dimensions. In other embodiments, the width of the trunk rest 502 and/or the head rest 504 may be approximately half of the width of a standard dimension mattress. For example, two people often share a Queen or King mattress. If only one person is using an embodiment of the contoured sleep system, a half-width embodiment accommodates one person while the other person sleeps on their portion of the mattress.

Figure 6:
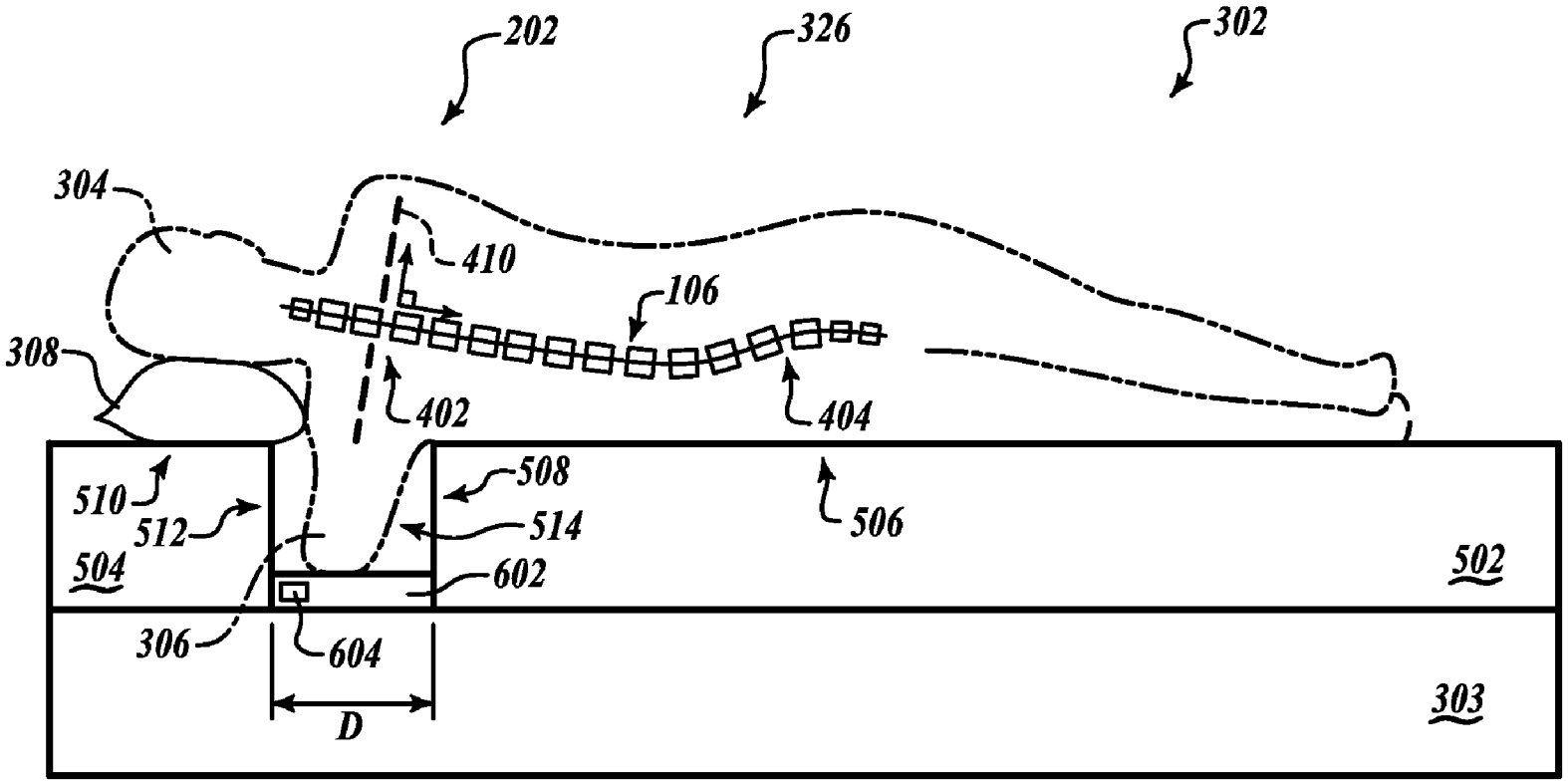
FIGS. 6-11 show alternative embodiments of the contoured sleep system with the person laying in the sleep-on-side position thereon.

FIG. 6 shows an alternative embodiment of the contoured sleep system with a person 202 laying in a sleep-on-side position 302 thereon. This embodiment includes a spacing member 602 between the trunk rest 502 and the head rest 504. The spacing member 602 is operable to maintain the separation distance D at a desired value.

In one embodiment, the spacing member 602 is adjustable. Any suitable adjustable means may be used. For example, the spacing member 602 may include a plurality of portions 604 that may be added or removed to define a value of the separation distance D. Other embodiments may employ an adjustable member 602 that is adjustable to define the separation distance D.

For convenience, the spacing member 602 is illustrated as being between the trunk rest 502 and a head rest 504. In some embodiments, the sides of the spacing member 602 may be optionally physically coupled to the trunk rest face 508 and/or the head rest face 512. For example, buttons, Velcro, zippers or other suitable fasteners may be used to physically couple the spacing member 602 to the trunk rest face 508 and/or head rest face 512.

In some embodiments, the spacing member 602 is configured to have its end portions (not illustrated) fit underneath the trunk rest 502 and a head rest 504 such that the weight of the trunk rest 502 and/or head rest 504, in addition to the person 202, secures the position of the spacing member 602. For example, a fabric sheet, ribbon, relatively thin rigid member, or the like may be attached to either or both ends of the spacing member 602. When placed under the trunk rest 502 and/or head rest 504, the weight of the trunk rest 502 and/or head rest 504, in addition to the person 202, secures the position of the spacing member 602.

Figure 7:
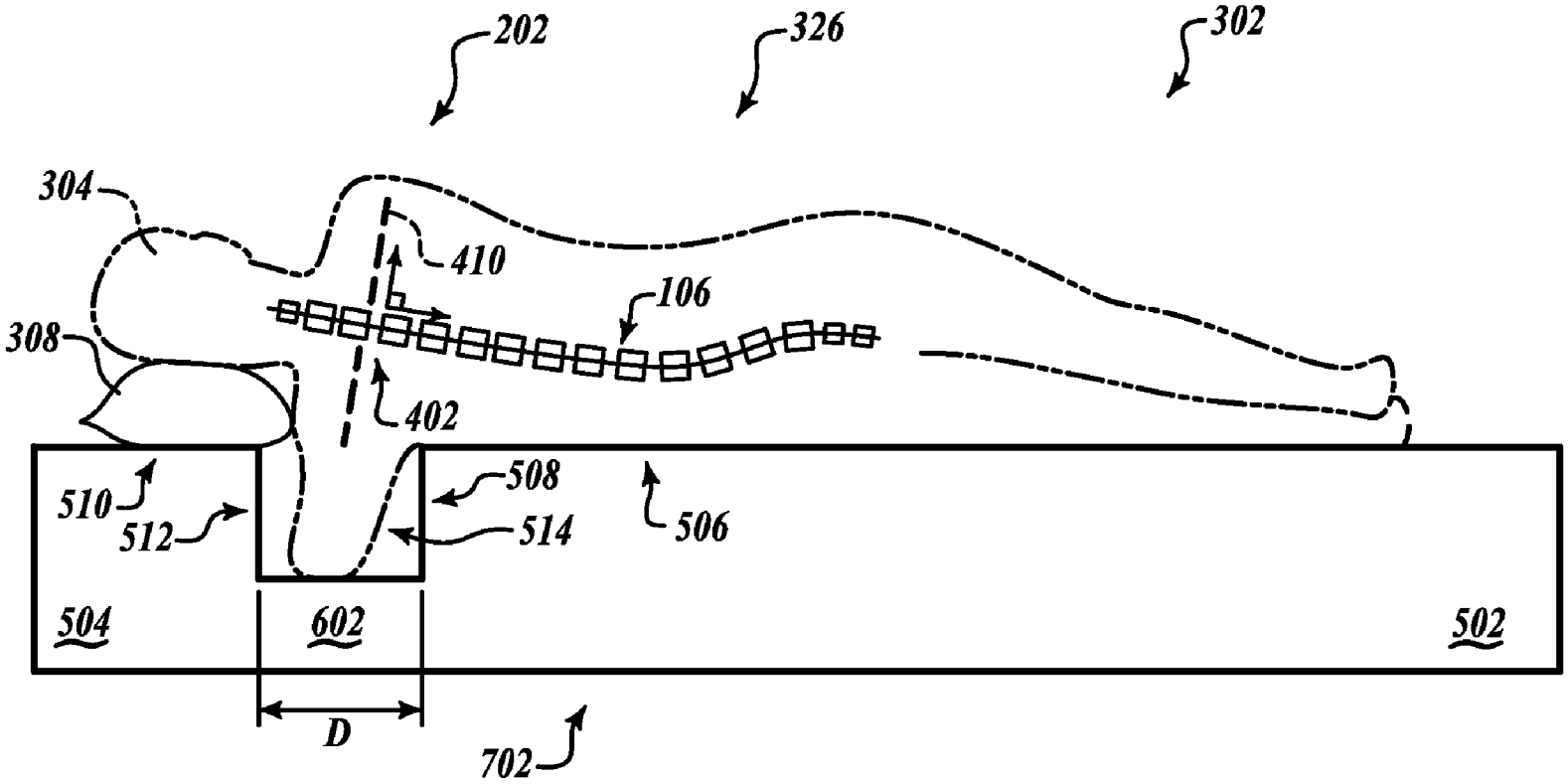

FIG. 7 shows an alternative embodiment of the contoured sleep system with the person 202 laying in the sleep-on-side position 302 thereon. In this exemplary embodiment, the trunk rest 502, the head rest 504, and the spacing member 602 are formed together in a unibody structure 702. The unibody structure 702 may be designed to fully and separately support the person 202 much like a conventional mattress that fits on a frame or that fits on top of a box spring structure or the like. Alternatively, or additionally, the unibody structure 702 may be configured to lay on top of a conventional mattress or other support structure. As seen in FIG. 7, the unibody structure is formed of an integral, unitary, flexible and generally homogeneous material.

Figure 8:
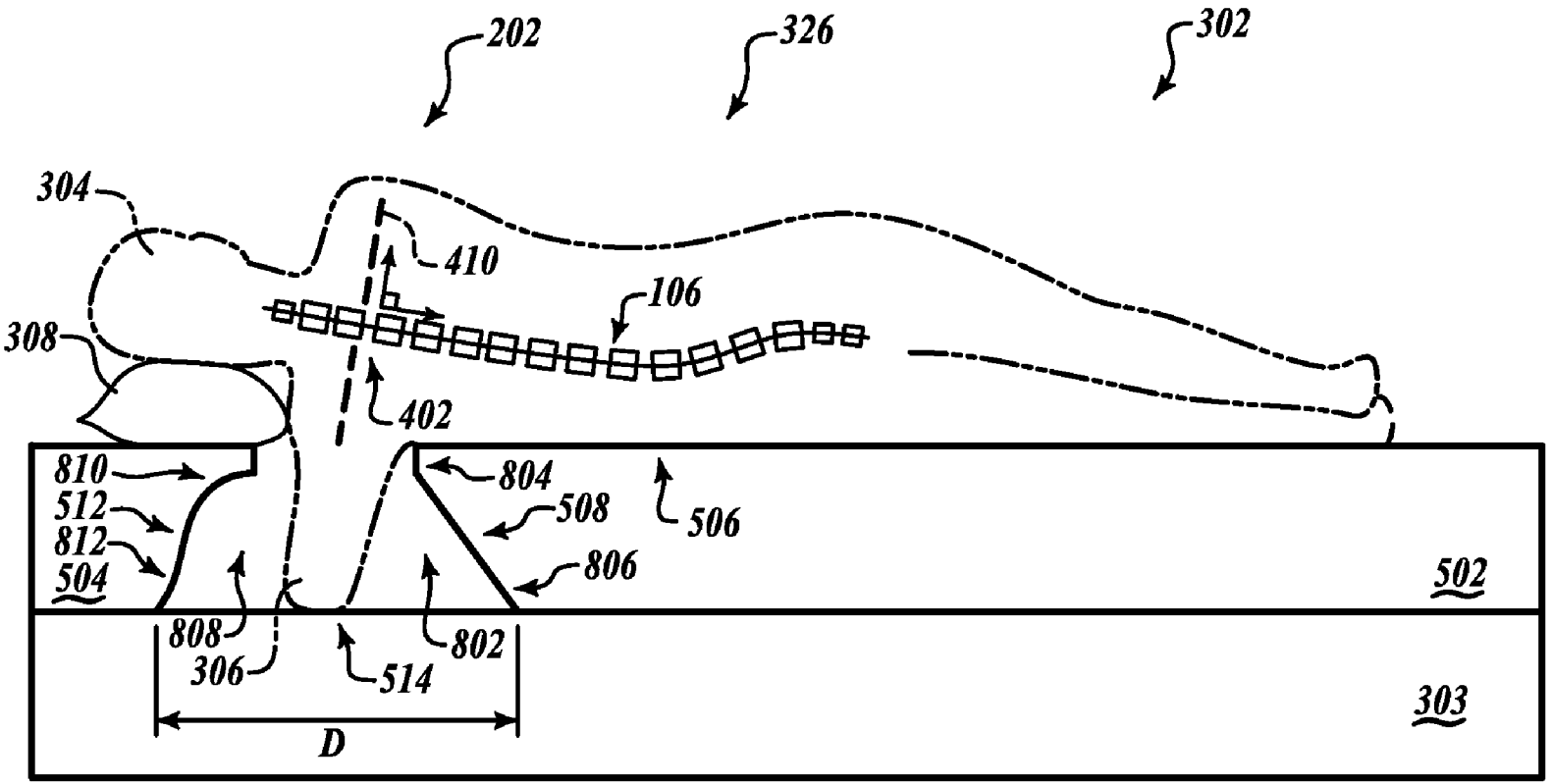

FIG. 8 shows an alternative embodiment of the contoured sleep system with the person 202 laying in the sleep-on-side position 302 thereon. The trunk rest face 508 is inwardly inclined such that the cavity 514 includes a region 802 that may facilitate a more comfortable accommodation of the lower arm 306. That is, the separation distance D increases from an upper portion 804 of the trunk rest face 508 to a lower portion 806 of the trunk rest face 508.

Additionally, or alternatively, the head rest face 512 is inwardly inclined such that the cavity 514 includes a region 808 that may facilitate a more comfortable accommodation of the lower arm 306. That is, the separation distance D increases from an upper portion 810 of the head rest face 512 to a lower portion 812 of the head rest face 512.

Figure 9:
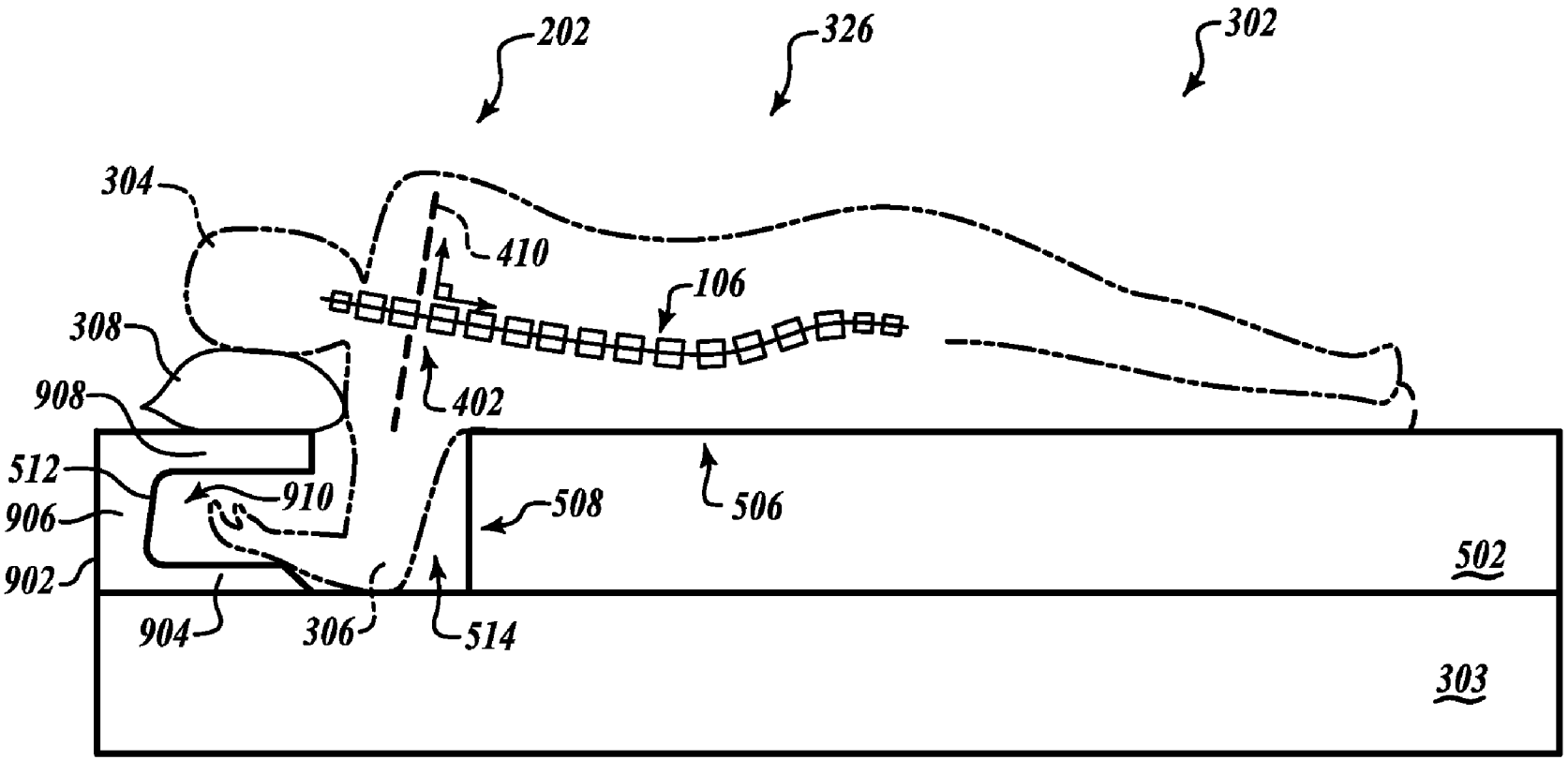

FIG. 9 shows an alternative embodiment of the contoured sleep system with the person 202 laying in the sleep-on-side 302 position thereon. The head rest 902 includes a head rest base 904, a head rest precipice support 906 coupled to the head rest base 904, and a head rest precipice 908 coupled to the head rest precipice support 906 and oriented above the head rest base 904. In this embodiment, the head rest face 512 is an exterior side of the head rest precipice support 906. As seen in FIG. 9, the head rest base 904, the head rest precipice support 906, and the head rest precipice 908 are portions of an integral, unitary, flexible and generally homogeneous unibody structure.

The head rest base 904, the head rest precipice support 906, and the head rest precipice 908 cooperate to form a head rest face concavity 910 such that the cavity 514 is enlarged. The enlarged cavity 514 more comfortably accommodates the person's lower arm 306.

Figure 10:
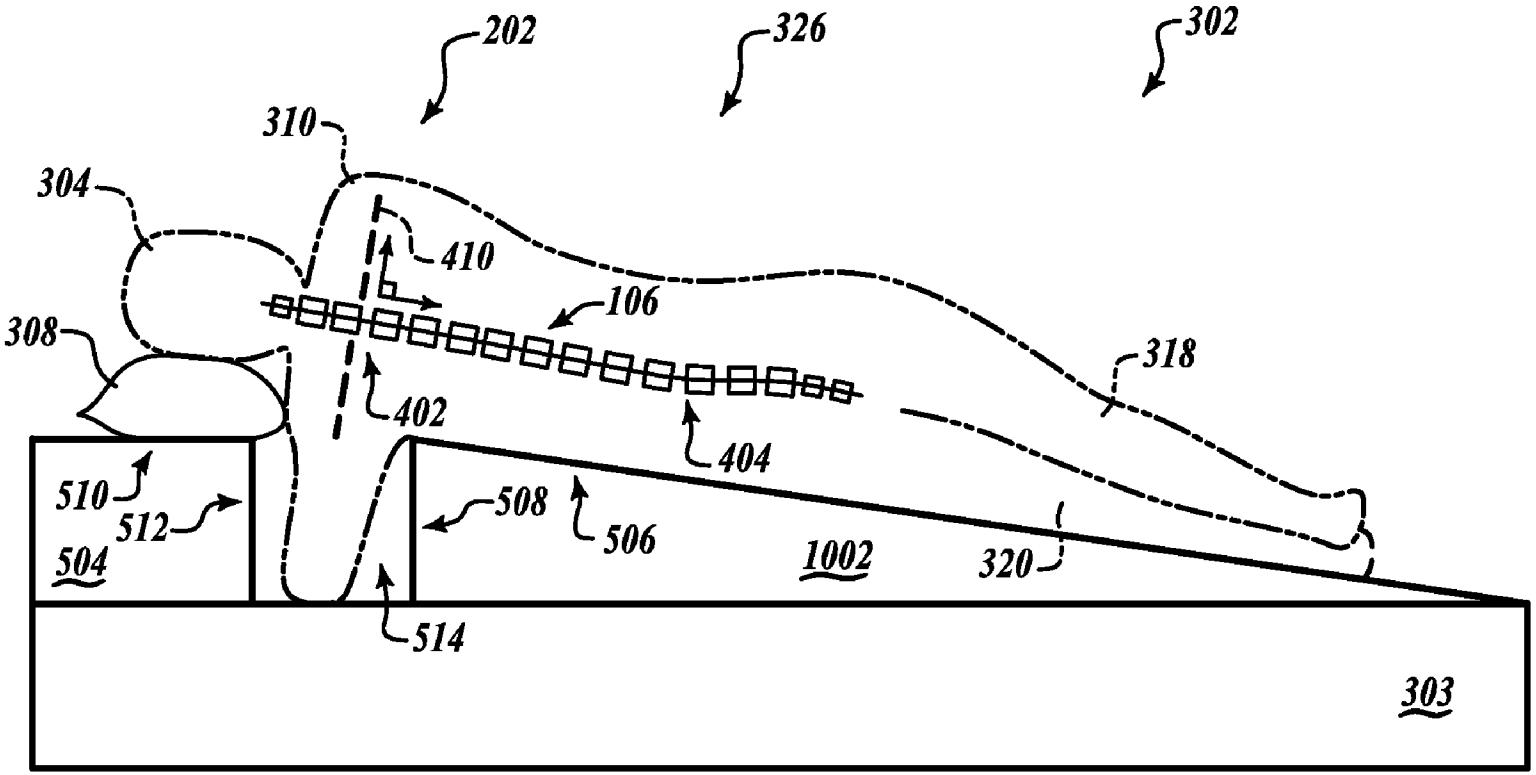

FIG. 10 shows an alternative embodiment of the contoured sleep system with the person 202 laying in the sleep-on-side position 302 thereon. In this exemplary embodiment, the trunk rest 1002 is substantially wedge shaped. The wedge shaped trunk rest 1002 results from an inclination of the trunk rest surface 506 in a downward direction from the trunk rest face 508. Accordingly, the wedge shaped trunk rest 1002 is operable to orient the person 202 laying in the sleep-on-side position 302 at an incline.

The inclined orientation of the person 202 may further align the spine 106 along region 402. Also, the inclined orientation of the person 202 may facilitate alignment of the spine 106 along the region 404. The inclined position may provide other benefits to the person 202, such as improved circulation, since the person's legs 318, 320 are lower than the person's shoulder 310. If the person 202 laying in the sleep-on-side position 302 is recovering from a cold or the flu, the inclined orientation may facilitate drainage of the person's sinus and/or lungs since the person's legs 318, 320 are lower than the person's shoulder 310.

Figure 11:
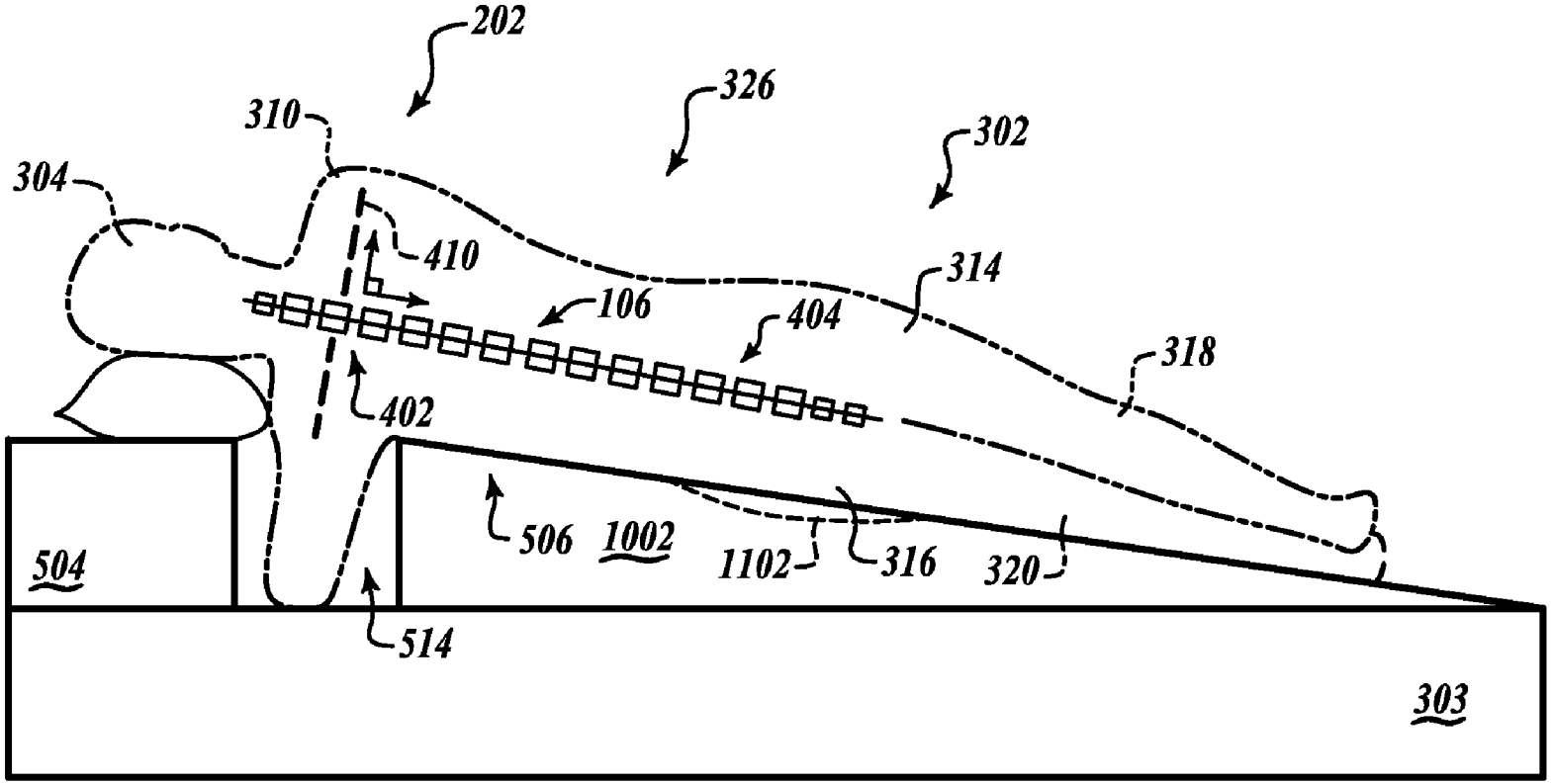

FIG. 11 shows an alternative embodiment of the contoured sleep system with the person 202 laying in the sleep-on-side position 302 thereon. In this exemplary embodiment, the trunk rest surface 506 of a substantially wedge shaped trunk rest 1002 includes a hip concavity 1102. The hip concavity 1102 is operable to further orient the person 202 laying in the sleep-on-side position 302 by lowering the person's hips 314, 316 relative to the person's head 304. Thus, the region 404 of the person's spine 106 is further aligned along the Sagittal plane 204 (FIG. 2). The hip concavity 1102 may be used in non-inclined embodiments of the contoured sleep position.

When the hip concavity 1102 is employed on the substantially wedge shaped trunk rest 1002 such that the person 202 laying in the sleep-on-side position 302 is oriented at an incline, the hip concavity 1102 aids in maintaining position of the person 202. That is, the person 202 does not slide down the incline.

Figure 12:
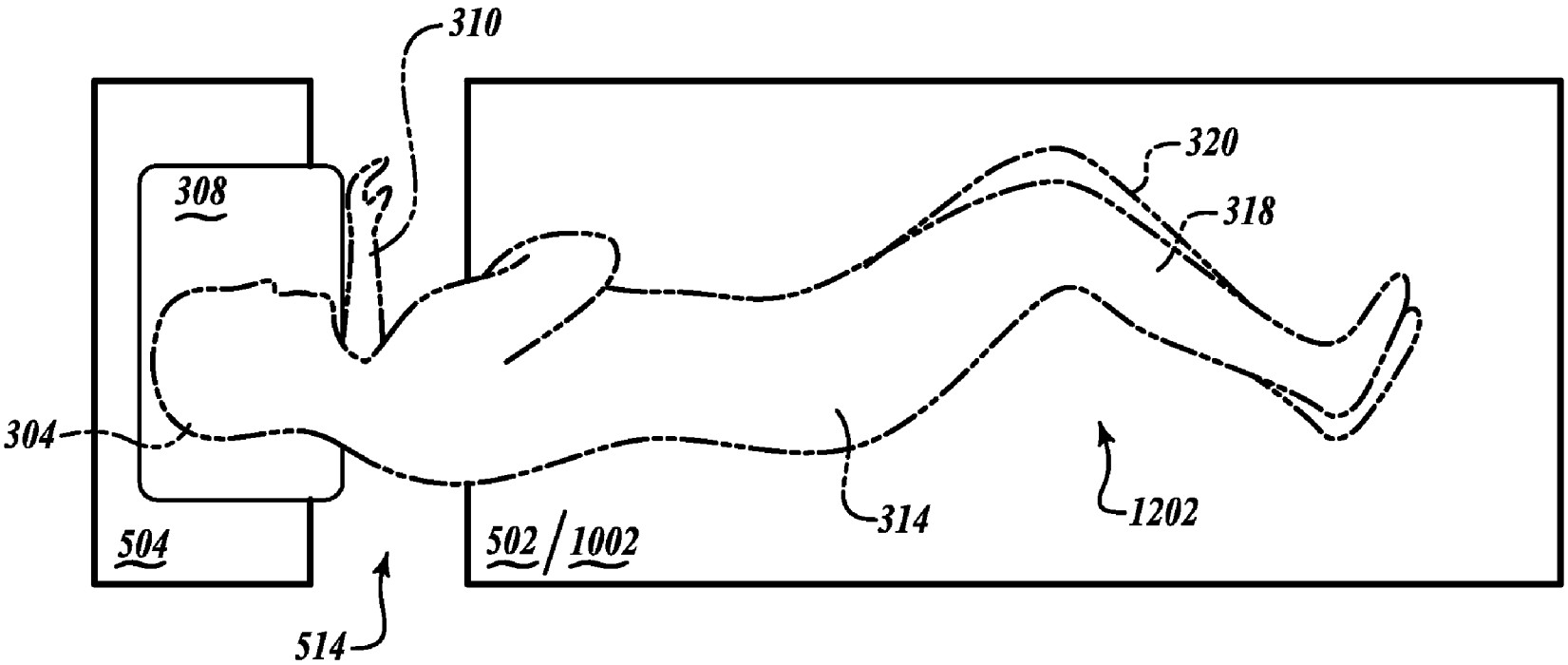
FIG. 12 shows a top view of a embodiment of the contoured sleep system with the person laying in the sleep-on-side position thereon.

FIG. 12 shows a top view of an embodiment of the contoured sleep system with the person 202 laying in the sleep-on-side position 302 thereon. Often, at least one of the person's legs 318, 320 may be oriented at an angle. That is, the person 202 laying in the sleep-on-side position 302 has one or both of their legs in a bent position 1202.

Figure 13:
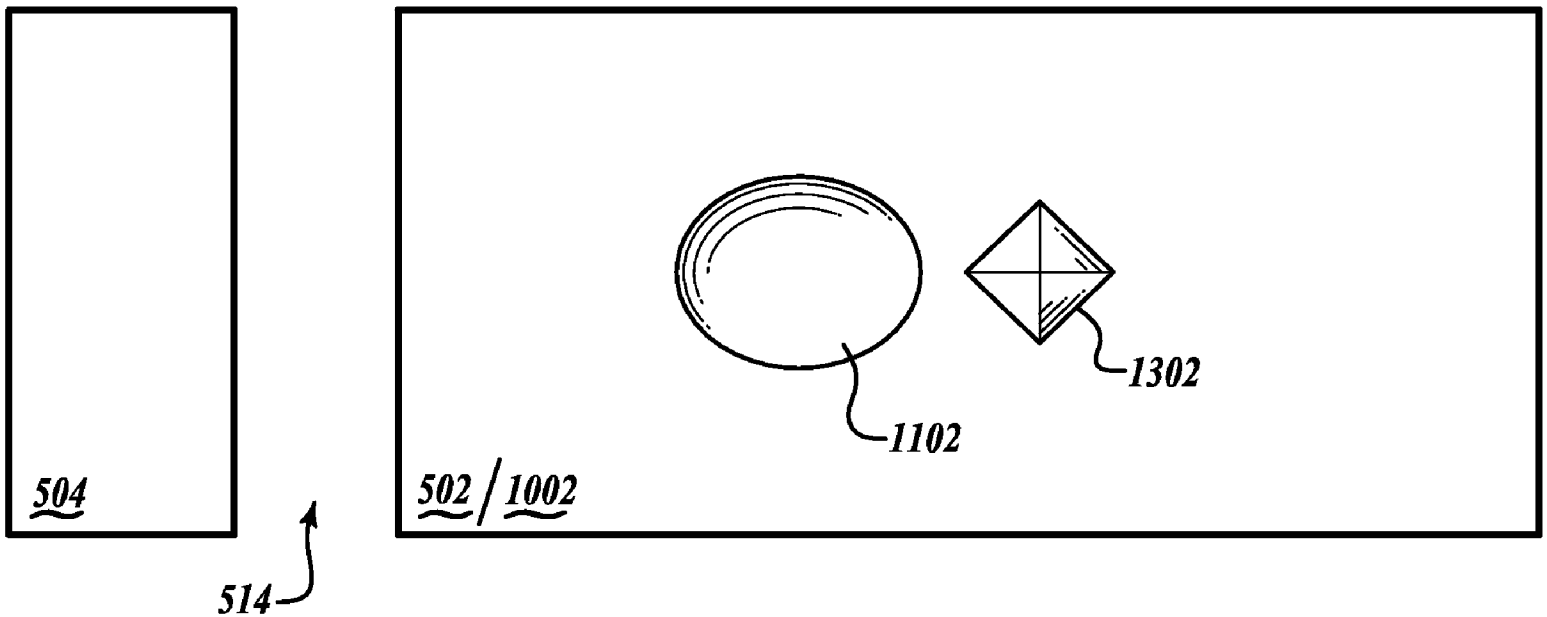
FIG. 13 shows a top view of an alternative embodiment of the contoured sleep system having a hip depression and a leg channel thereon.

FIG. 13 shows a top view of an alternative embodiment of the contoured sleep system having an optional hip depression 1102 and an optional leg channel 1302 thereon. Leg channel 1302 may be a depression or a protrusion. The leg channel 1302 maintains the person's legs 318, 320 in the bent position 1202 (FIG. 12). The leg channel 1302 may be formed by a trench in the trunk rest surface 506 of the wedge shaped trunk rest 1002. In other embodiments, the leg channel 1302 may be formed by an outward protrusion on the trunk rest surface 506 of the wedge shaped trunk rest 1002.

Maintaining the person's legs 318, 320 in the bent position 1202 may further facilitate spinal alignment. When the leg channel 1302 is employed on the substantially wedge shaped trunk rest 1002 such that the person 202 laying in the sleep-on-side position 302 is oriented at an incline, the leg channel 1302 aids in maintaining position of the person 202.

In the various embodiments described above, the spacing member 602 (FIGS. 6 and 7) may be optionally included as a separate member. Or, the trunk rest 502 or the trunk rest 1002, the head rest 504, and the spacing member 602 may form a unibody structure 702 (FIG. 7) as described above. The spacing member 602 may be used with any embodiment.

In some embodiments, the height of the head rest face 512 is greater than a height of the trunk rest face 508. That is, the height of the head rest 504 is greater than the height of the trunk rest 502. Accordingly, the person's spine 106 may be further aligned along the Sagittal plane 204 by lowering the person's shoulders and/or hips relative to the person's head 304 when the person 202 is laying in the sleep-on-side position 302.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention, in which an exclusive property or privilege is claimed, are defined as follows:

1. A sleep support system comprising:

a trunk rest having a trunk rest surface and a trunk rest face, wherein the trunk rest surface is operable to support a trunk of a person laying in a sleep-on-side position, wherein the trunk rest face is defined by an upper portion and a lower portion; and a head rest having a head rest surface and a head rest face, wherein the head rest face is defined by an upper portion and a lower portion, such that when the head rest is placed in operative relation to the trunk rest, the head rest face opposes the trunk rest face and is separated from the trunk rest face by a separation distance, and a spacing member disposed between the lower portion of the trunk rest face and the lower portion of the head rest face, wherein the spacing member is operable to maintain the separation distance between the lower portion of the trunk rest face and the lower portion of the head rest face, such that the trunk rest, the head rest and the spacing member cooperate to define a cavity with at least a portion disposed below the end of the trunk rest to receive a lower portion of an arm of the person laying in the sleep-on-side position.

2. The sleep support system of claim 1, wherein the separation distance defined by the relative position between the upper portion and the lower portion of the trunk rest face increases from the upper portion of the trunk rest face to the lower portion of the trunk rest face.

3. The sleep support system of claim 1, wherein the trunk rest, the head rest and the spacing member are formed as an integral and generally homogenous unibody structure.

4. The sleep support system of claim 3, wherein the unibody trunk rest, head rest and spacing member are operable to rest on a top of a mattress.

5. The sleep support system of claim 3, wherein portions of the unibody trunk rest, head rest and spacing member are made of a flexible material.

6. The sleep support system of claim 1, wherein the trunk rest surface is inclined from the upper portion of the trunk rest face.

7. The sleep support system of claim 1, wherein the head rest face has a vertical dimension or height substantially equal to a vertical dimension of the trunk rest face.

8. The sleep support system of claim 1, wherein the head rest includes:

a head rest base;

a head rest precipice support coupled to the head rest base, wherein the head rest face is an exterior side of the head rest precipice support; and a head rest precipice coupled to the head rest precipice support and oriented above the head rest base, wherein the head rest base, the head rest precipice support, and the head rest precipice are portions of an integral, unitary, flexible and generally homogeneous unibody structure and cooperate to form the head rest face concavity.

9. The sleep support system of claim 1, wherein the separation distance increases from the upper portion of the head rest face to the lower portion of the head rest face.

10. The sleep support system of claim 1, wherein the trunk rest face defines:

a trunk rest face concavity, the trunk rest face concavity configured to further receive the lower arm.

11. The sleep support system of claim 1, wherein the trunk rest surface includes a hip concavity.

12. A method to support a person laying in a sleep-on-side position, the method comprising:

supporting a trunk of the person laying in the sleep-on-side position on a surface of a trunk rest, wherein the trunk rest is defined by the trunk rest surface and a trunk rest face, and wherein the trunk rest face is defined by an upper portion and a lower portion;

supporting a head of the person laying in the sleep-on-side position on a surface of a head rest, wherein the head rest is defined by the head rest surface and a head rest face, and wherein the head rest face is defined by an upper portion and a lower portion, such that when the head rest is placed in operative relation to the trunk rest, the head rest face opposes the trunk rest face and is separated from the trunk rest face by a separation distance, and such that the opposing head rest face and the trunk rest face define a cavity with at least a portion disposed below the end of the trunk rest; and receiving an arm of the person laying in the sleep-on-side position on a surface in the cavity.

13. The method of claim 1, wherein a spacing member is disposed between the lower portion of the trunk rest face and the lower portion of the head rest face, and is operable to maintain the separation distance between the lower portion of the trunk rest face and the lower portion of the head rest face.

* * * * *